US011629848B1

(12) United States Patent
Yang

(10) Patent No.: US 11,629,848 B1
(45) Date of Patent: Apr. 18, 2023

(54) LAMP HOLDER FOR COLORED LAMP

(71) Applicant: ZHEJIANG FEITIAN OPTOELECTRONIC CO.,LTD., Taizhou (CN)

(72) Inventor: Guangke Yang, Taizhou (CN)

(73) Assignee: ZHEJIANG FEITIAN OPTOELECTRONIC CO., LTD., Taizhou (CN)

( * ) Notice: Subject to any disclaimer, the term of this patent is extended or adjusted under 35 U.S.C. 154(b) by 0 days.

(21) Appl. No.: 17/953,265

(22) Filed: Sep. 26, 2022

(51) Int. Cl.
*F21V 19/00* (2006.01)
*F21V 23/06* (2006.01)

(52) U.S. Cl.
CPC ..... *F21V 19/00* (2013.01); *F21V 23/06* (2013.01)

(58) Field of Classification Search
CPC ..... F21V 19/00; F21V 23/06
See application file for complete search history.

(56) References Cited

U.S. PATENT DOCUMENTS

2018/0195698 A1* 7/2018 Ma ..... F21V 19/00

FOREIGN PATENT DOCUMENTS

CN 204732647 U 10/2015
CN 207230319 U 4/2018
CN 109099358 A * 12/2018 ..... F21S 8/04
CN 111350957 A * 6/2020
CN 110986011 B * 1/2021
CN 216619733 U 5/2022

OTHER PUBLICATIONS

English translation of CN-111350957-A Hu, published 2020 (Year: 2020).*
English translation of Liu CN-110986011-B, published Jan. 2021 (Year: 2021).*
English translation of Bai CN-109099358-A, published 2018 (Year: 2018).*

* cited by examiner

*Primary Examiner* — Evan P Dzierzynski
(74) *Attorney, Agent, or Firm* — Nitin Kaushik

(57) ABSTRACT

The present invention discloses a lamp and is intended to provide a novel lamp holder for a colored lamp. The key point of the technical solution of the present invention is as follows: a mounting base is fixedly connected to a pedestal through a buckle combining part; a wiring plate is arranged in the pedestal; the buckle combining part comprises a buckle arranged on the mounting base and a slot formed in the pedestal; a peripheral side of the wiring plate is provided with wiring guide blocks; each wiring guide block abuts against an inner wall of the pedestal to form a wiring through hole; the inner wall of the pedestal is provided with a positioning slot; an outer wall of the wiring plate is provided with a positioning block fitting the positioning slot; and the positioning slot and the positioning block are matched for limiting the wiring plate.

7 Claims, 3 Drawing Sheets

LAMP HOLDER FOR COLORED LAMP

TECHNICAL FIELD

The present invention relates to the technical field of colored lamps, more particularly to a novel lamp holder for a colored lamp.

BACKGROUND

With improvement of people's living standard, many decorative lamps will be used in holidays and festivals to show festive air, and decorative lighting of various models dresses up big streets and small alleys. For example, at Christmas time, a rubber-covered wire lamp is hung on a Christmas tree to create atmosphere. When the rubber-covered wire lamp is hung on the Christmas tree, the rubber-covered wire lamp is twisted and even falls as the top end cannot be fixed. With respect to a lamp holder of the rubber-cover wire lamp in the current market, a mounting base and a pedestal are fixed through screws, and it is needed to split the whole lamp, wire and then fix the lamp during wiring. It is time-consuming and labor-wasting and extremely inconvenient to mount the rubber-covered wire lamp on the lamp holder, and therefore, it is an urgent need of a lamp holder which is easily and rapidly mounted and is convenient to wire the rubber-covered wire lamp as well.

SUMMARY

In order to overcome deficiencies in the prior art, the objective of the present invention is to provide a novel lamp holder for a colored lamp.

In order to achieve the above-mentioned objective, the present invention provides the following technical solution: a novel lamp holder for a colored lamp includes a pedestal, a wiring plate and a mounting base, where the mounting base is fixedly connected to the pedestal through a buckle combining part; the wiring plate is arranged in the pedestal and is used for guiding and placing an electric wire; the buckle combining part includes a buckle arranged on the mounting base and a slot formed in the pedestal; a peripheral side of the wiring plate is provided with wiring guide blocks; and each of the wiring guide blocks abuts against an inner wall of the pedestal to form a wiring through hole.

The present invention is further arranged such that the inner wall of the pedestal is provided with a positioning slot; an outer wall of the wiring plate is provided with a positioning block fitting the positioning slot; the positioning slot and the positioning block are matched for limiting the wiring plate.

The present invention is further arranged such that the mounting base is internally provided with a mounting channel, the mounting channel is integrally connected to the mounting base through a connecting plate, and a side wall of the mounting base is provided with an adjusting groove.

The present invention is further arranged such that the mounting base is provided with an insertion part, the buckle is arranged on the insertion part, and a ratio of the width of the adjusting groove to the perimeter of the insertion part is 1:50.

The present invention is further arranged such that the wiring plate is further provided with wiring columns.

The present invention is further arranged such that the mounting base is a truncated cone-shaped groove body inserted in a direction of the pedestal along the mounting base, with gradually increased cross sectional area.

The present invention is further arranged such that a ratio of a separation distance between adjacent wiring columns to a separation distance between adjacent wiring guide blocks is 8:3.

By adopting the technical solution, electric wires through guide positions of the wiring columns first and then pass through the wiring guide blocks. The electric wires are combed and limited again through the wiring guide blocks, so that it can be guaranteed that the electric wires of the rubber-covered wire lamp are prevented from winding each other. The electric wires stretching from the wiring plate are scattered all around to form uniform line types on the peripheral side of the Christmas tree, which is beautiful and concise. The wiring plate is limited by the positioning block, so that it can be guaranteed that the position of the wiring through hole is fixed after the wiring plate is mounted and disassembled every time. Meanwhile, the wiring plate and the pedestal are detachably connected, so that it is simple and rapid to mount and detach.

The mounting base and the pedestal are detachably connected through the buckle combining part, so that it is convenient and easy to mount and detach. The mounting base and the pedestal can be used simultaneously or independently. An ornament can be inserted into the mounting base through the mounting channel arranged in the mounting base. The adjusting groove can guarantee that the size of the insertion part can be adjusted automatically when the mounting base is inserted and detached, so that it is convenient to mount and detach the mounting part.

Numerals of drawings in figures: 1—pedestal; 11—positioning slot; 12—slot; 2—wiring plate; 21—positioning block; 22—wiring guide block; 23—wiring column; 3—mounting base; 31—buckle; 32—adjusting groove; 33—mounting channel.

DETAILED DESCRIPTION OF THE EMBODIMENTS

Figure 1:
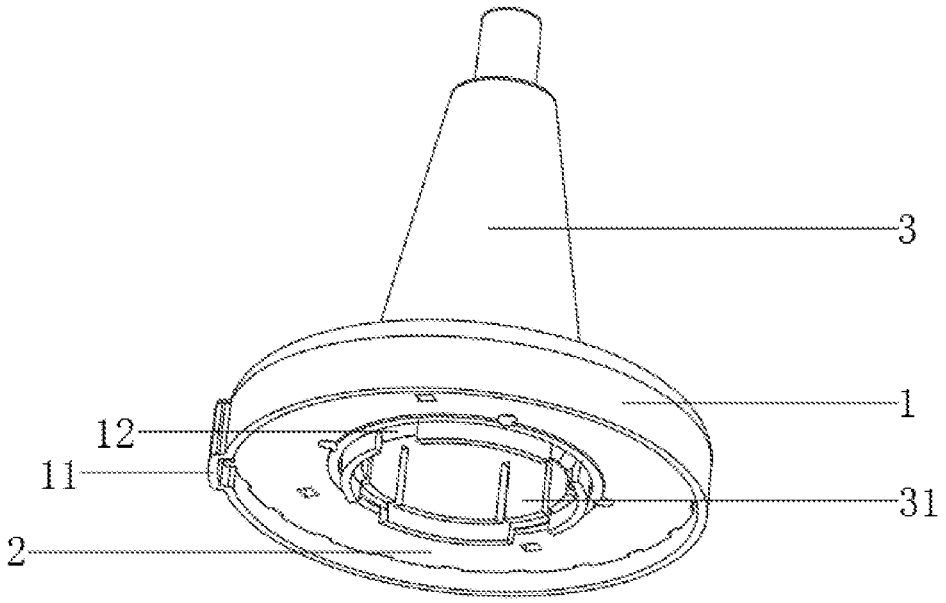
FIG. 1 is a schematic structural diagram of an embodiment of a novel lamp holder for a colored lamp of the present invention.
Figure 2:
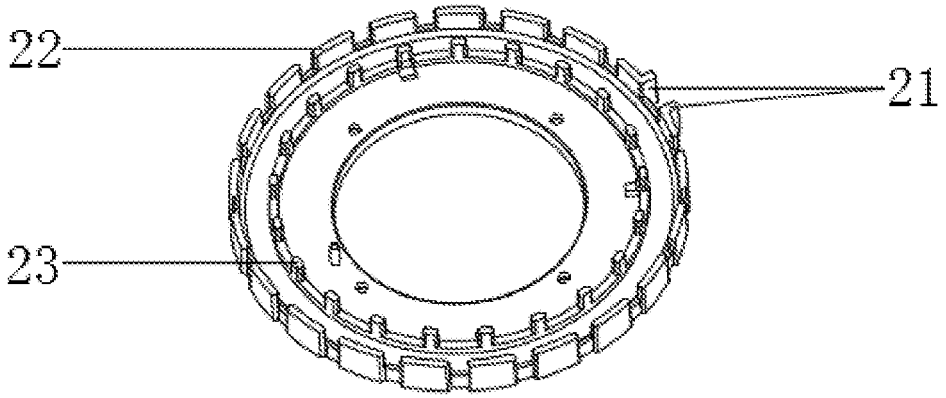
FIG. 2 is a schematic structural diagram of a wiring plate.
Figure 3:
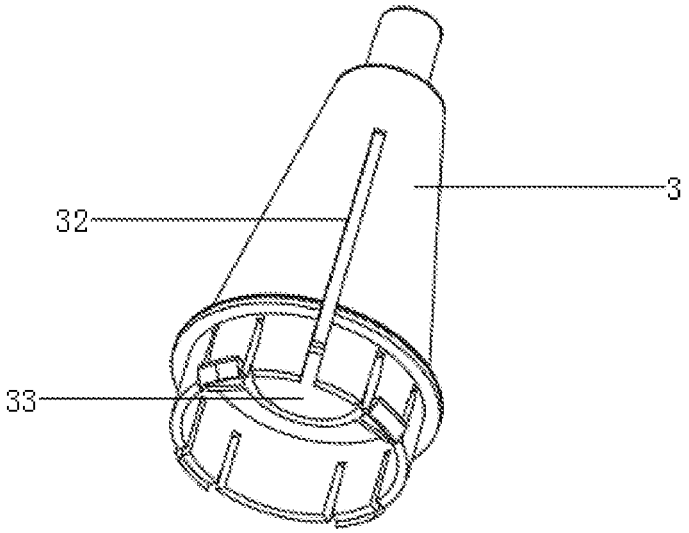
FIG. 3 is a schematic structural diagram of a mounting base.

Referring to FIG. 1 to FIG. 3, an embodiment of a novel lamp holder for a colored lamp of the present invention is further described.

For ease of description, spatial relative terms such as "above", "below", "left" and "right" are used in the embodiment to describe a relationship of an element or feature shown in figures relative to another element or feature. It should be understood that besides orientations shown in the figures, the spatial terms are intended to include different orientations of the device in use or operation. For example, if the device in the figures is inverted, it is narrated that the element located "below" other elements or features will be positioned "above" other elements or features. Therefore, the exemplary term "below" can include two orientations: above and below. The device can be positioned in other ways (rotated at 90 degrees or located in other orientations), and corresponding explanation can be made on relative spatial description used here.

Furthermore, relational terms such as "first" and "second" are merely used for distinguishing a part from another part with a same name rather than requiring or hinting any actual relationship or sequence among the parts.

A novel lamp holder for a colored lamp includes a pedestal 1, a wiring plate 2 and a mounting base 3, where the mounting base 3 is fixedly connected to the pedestal 1 through a buckle 31 combining part; the wiring plate 2 is arranged in the pedestal 1 and is used for guiding and placing an electric wire; the buckle 31 combining part includes a buckle 31 arranged on the mounting base 3 and a slot 12 formed in the pedestal 1; a peripheral side of the wiring plate 2 is provided with wiring guide blocks 22; each of the wiring guide blocks 22 abuts against an inner wall of the pedestal 1 to form a wiring through hole; the pedestal 1 is arranged in an annular groove body; an inner groove wall is uniformly provided with four slots 12 used for being detachably connected to the mounting base 3; a groove body of the pedestal 1 is uniformly provided with four connecting columns with screw holes; the connecting columns are fixedly connected to the wiring plate 2 through screws; the positioning slot 11 is formed in the outer wall of the pedestal 1; an inner chamber encircled by the pedestal 1 and the wiring plate 2 is used for placing a circuit board; and the circuit board can be connected to the rubber-covered wire or a copper wire as the electric wire of the decorative lighting.

The wiring plate 2 is a ring-shaped plastic plate provided with the wiring guide blocks 22 and the wiring columns 23 on the surface. The wiring guide blocks 22 are arranged at the edge of the peripheral side of the wiring plate 2. There is a separation distance between the adjacently arranged wiring guide blocks 22, and the separation distance and the outer wall of the pedestal 1 jointly encircle the wiring through hole. The inner chamber encircled by the wiring plate 2 and the pedestal 1 is used for placing the circuit board with the electric wire. The circuit board is provided with a plurality of electric wires connected to the rubber-covered wire lamp. Each electric wire uses one wiring through hole, so that it can be guaranteed that failure of the rubber-covered wire lamp as fine electric wires wind each other is avoided. The wiring plate 2 is further provided with the wiring columns 23, and the quantity of the wiring columns 23 is identical to that of the wiring guide blocks 22 and the wiring columns and the wiring guide blocks are relatively fixed in position, namely, the wiring columns 23 correspond to the wiring guide blocks 22 one by one to jointly limit and guide the electric wires. The wiring plate 2 is further provided with four through holes for mounting and fixing screws. The screws are driven into the connecting columns arranged on the pedestal 1 through the through holes so as to fix the wiring plate 2 and the pedestal 1. The edge of the wiring plate 2 is provided with the positioning block 21 which is matched with the positioning slot 11 to guarantee that the wiring through hole is fixed in position. The ratio of the separation distance between adjacent wiring columns 23 to the separation distance between adjacent wiring guide blocks 22 is 8:3. The copper wire or the rubber-covered wire preferably passes through a gap formed between the adjacent wiring columns 23 and then passes through a gap between the adjacent wiring guide blocks 22. The separation distance between the wiring columns 23 is relatively great, and the separation distance between the wiring guide blocks 22 is relatively small. The arrangement mode can guarantee that the copper wire or the rubber-covered wire preferably passes through the relatively great separation distance and further passes through the relatively small separation distance, thereby guaranteeing that the copper wire or the rubber-covered wire are not intersected and overlapped.

The mounting base 3 includes the insertion part, an outer shell of the mounting part and the mounting channel 33. The outer shell of the mounting part is a truncated cone-shaped groove body inserted in a direction of the pedestal 1 along the mounting base 3, with gradually increased cross sectional area. The insertion part is arranged at the side of the outer shell of the mounting part with a large cross sectional area. One end of the mounting channel 33 is arranged at the side of the outer shell of the mounting part with a small cross sectional area, and the other end is arranged in a cavity in the outer shell of the mounting part. The mounting channel 33 is integrally connected to the mounting base 3 through the connecting plate. The outer shell of the mounting part and the insertion part are provided with the adjusting groove 32 connected integrally. The ratio of the width of the adjusting groove 32 to the perimeter of the side of the outer shell of the mounting part with the large cross sectional area is 1:50. The adjusting groove 32 is used for self-adaptively adjusting the cross sectional area itself when the mounting base 3 is inserted into the pedestal 1. When the ratio is too small, the adjusting capacity of the mounting base 3 is weakened, so that a large action force is needed to insert the mounting part to the pedestal 1. When the ratio is too large, and the mounting base 3 is arranged on the pedestal 1, a loose phenomenon occurs, so that the mounting base 3 falls off. A connection between the insertion part and the outer shell of the mounting part is provided with a mounting ring. When the mounting part is inserted into the pedestal 1, the mounting ring is wrapped at a connecting gap, so that it can be guaranteed that the lamp holder is not affected by dust and water vapor internally. The mounting part is uniformly provided with four grooves. One of the grooves is internally provided with the buckle 31, and the buckle 31 can guarantee that stress in all directions is uniform and stable when the mounting part is inserted into the pedestal 1.

The above mentioned is merely the preferred embodiment of the present invention and is not used to limit the present invention. Common modification and replacement made by those skilled in the art within the technical solution of the present invention shall be regarded as within the protection scope of the present invention.

What is claimed is:

1. A novel lamp holder for a colored lamp, comprising a pedestal (1), a wiring plate (2) and a mounting base (3), wherein the mounting base (3) is fixedly connected to the pedestal (1) through a buckle (31) combining part; the wiring plate (2) is arranged in the pedestal (1) and is used for guiding and placing an electric wire; the buckle (31) combining part comprises a buckle (31) arranged on the mounting base (3) and a slot (12) formed in the pedestal (1); a peripheral side of the wiring plate (2) is provided with wiring guide blocks (22); and each of the wiring guide blocks (22) abuts against an inner wall of the pedestal (1) to form a wiring through hole.

2. The novel lamp holder for a colored lamp according to claim 1, wherein the inner wall of the pedestal (1) is provided with a positioning slot (11); an outer wall of the wiring plate (2) is provided with a positioning block (21) fitting the positioning slot (11); the positioning slot (11) and the positioning block (21) are matched for limiting the wiring plate (2).

3. The novel lamp holder for a colored lamp according to claim 2, wherein the mounting base (3) is internally provided with a mounting channel (33), the mounting channel (33) is integrally connected to the mounting base (3) through a connecting plate, and a side wall of the mounting base (3) is provided with an adjusting groove (32).

4. The novel lamp holder for a colored lamp according to claim 3, wherein the mounting base (3) is provided with an insertion part, the buckle (31) is arranged on the insertion part, and a ratio of the width of the adjusting groove (32) to the perimeter of the insertion part is 1:50.

5. The novel lamp holder for a colored lamp according to claim 4, wherein the wiring plate (2) is further provided with wiring columns (23).

6. The novel lamp holder for a colored lamp according to claim 5, wherein the mounting base (3) is a truncated cone-shaped groove body inserted in a direction of the pedestal (1) along the mounting base (3), with gradually increased cross sectional area.

7. The novel lamp holder for a colored lamp according to claim 6, wherein a ratio of a separation distance between adjacent wiring columns (23) to a separation distance between adjacent wiring guide blocks (22) is 8:3.

* * * * *